US006019040A

United States Patent [19]

Möllers

[11] Patent Number: 6,019,040

[45] Date of Patent: Feb. 1, 2000

[54] METHOD OF METERING INK INTO AN INK DUCT VIA SENSING INK ZONE FILL LEVELS

[75] Inventor: Renko Möllers, Sendenhorst, Germany

[73] Assignee: Heidelberger Druckmaschinen AG, Heidelberg, Germany

[21] Appl. No.: 09/250,871

[22] Filed: Feb. 16, 1999

[30] Foreign Application Priority Data

Feb. 14, 1998 [DE] Germany ..... 198 06 171
Jan. 28, 1999 [DE] Germany ..... 199 03 449

[51] Int. Cl.[7] ..... B41F 31/02

[52] U.S. Cl. ..... 101/366; 101/365; 101/367

[58] Field of Search ..... 101/350, 351, 101/363, 366, 207–210, 356, 148, 335, 350.1, 351.1, 352.01, 367; 118/258, 259; 222/51, 64, 67

[56] References Cited

U.S. PATENT DOCUMENTS 3,848,529 11/1974 Gegenheimer et al. ..... 101/363
4,479,433 10/1984 MacPhee et al. ..... 101/364
4,709,633 12/1987 Woestman ..... 101/163
4,787,313 11/1988 Osborn et al. ..... 101/366
5,265,535 11/1993 Isowa et al. ..... 101/350
5,724,890 3/1998 Deschner et al. ..... 101/366

*Primary Examiner*—Kimberly L. Asher
*Attorney, Agent, or Firm*—Herbert L. Lerner; Laurence A. Greenberg

[57] ABSTRACT

A method for metering printing ink into an ink duct of a printing press, in which a metering device mounted on a carriage is reciprocatingly displaceable in a longitudinal direction of an ink duct having ink zones arranged next to one another in rows, the metering device including at least one sensor for monitoring a fill level in the ink duct, and a device for filling the ink in the ink duct, includes combining a plurality of the ink zones into a metering region, remetering printing ink to the metering region if a minimal fill level is determined by the sensor, and supressing a fill level measurement and remetering for at least one further crossover of the remetered metering region; and a device for performing the method.

11 Claims, 1 Drawing Sheet

METHOD OF METERING INK INTO AN INK DUCT VIA SENSING INK ZONE FILL LEVELS

BACKGROUND OF THE INVENTION

1. Field of the Invention

The invention relates to a method and a device for metering printing ink into an ink duct of a printing press.

From the published German Patent Document DE 195 12 727 A1, a device for feeding ink to an ink duct of a printing press has become known heretofore. This device includes an ink cartridge moving reciprocatingly along a crossbar above the ink duct, and filling the ink duct with printing ink whenever the fill level becomes too low. Also located on a carriage whereon the cartridge is received is at least one sensor that monitors the fill level and, as required, causes a refilling of the ink duct by the cartridge.

SUMMARY OF THE INVENTION

Starting from this state of the art, it is an object of the invention to provide a method for metering printing ink into an ink duct of a printing press wherein the metering of printing ink to the ink duct is improved so that a fill level of printing ink in the ink duct can be kept constant with such assurance that the printing job can be performed with a minimal ink reservoir.

With the foregoing and other objects in view, there is provided, in accordance with one aspect of the invention, a method for metering printing ink into an ink duct of a printing press, in which a metering device mounted on a carriage is reciprocatingly displaceable in a longitudinal direction of an ink duct having ink zones arranged next to one another in rows, the metering device including at least one sensor for monitoring a fill level in the ink duct, and a device for filling the ink in the ink duct, which comprises combining a plurality of the ink zones into a metering region, remetering printing ink to the metering region if a minimal fill level is determined by the sensor, and supressing a fill level measurement and remetering for at least one further crossover of the remetered metering region.

In accordance with another mode, the method of the invention includes considering each metering region as an independent controlled system.

In accordance with another mode, the method of the invention includes reciprocatingly moving the metering device periodically, and determining the periodic reciprocating movement by the capability of restoring a measurable fill level.

In accordance with an added mode, the method of the invention includes applying the printing ink onto the ink doctor.

In accordance with an additional mode, the method of the invention includes defining the capability of restoring the measurable fill level as a function of the viscosity of the printing ink.

In accordance with an alternative mode, the method of the invention includes defining the capability of restoring the measurable fill level as a function of the rotary motion of the ink doctor.

In accordance with yet another mode, the method of the invention includes combining those ink zones having mutual influence into the one metering region.

In accordance with yet a further mode, the reciprocating displacement is constant.

In accordance with yet an added mode, the method of the invention includes interrupting the reciprocating displacement of the metering device when a measurement and a metering position, respectively, are reached.

In accordance with yet an additional mode, the method of the invention includes applying the equation $s=v\times t$, wherein s=distance, v=velocity and t=time, for determining the position of the ink zone and of the metering region, respectively, above which the metering device is located.

In accordance with still another mode, the method of the invention includes interrogating a position switch at a zero position and at a reversal position.

In accordance with a concomitant aspect of the invention, there is provided a device for metering printing ink into an ink duct of a printing press, including an ink doctor and a traversing metering device located above the ink duct and the ink doctor, comprising an agitator assigned to the metering device.

Advantageously, the invention divides up the total length of the ink duct into stationary metering regions. Based upon the mutual influence of adjacent ink zones, a plurality of the ink zones can be combined into one metering region. Each metering region is considered to be an independent controlled system. A further development provides for the metering region to be defined as a function of the particular subject to be printed, or in other words in a job-specific manner. This offers the advantage that the mutual influence, which arises from the different, subject-dependent opening of the ink zones, can always be located within one metering region. It is also possible, with relatively uniform ink distribution, which has an effect upon a relatively uniform opening of all of the ink zones, to enlarge the metering regions and, in a limiting case, to define the entire ink duct as a metering region.

The method of the invention also proposes that the printing ink not be delivered directly to the ink duct but instead initially applied to or loaded on the ink doctor that, by the rotary motion thereof, transports the printing ink to the ink duct. Because, due to the high viscosity of the ink as it emerges from the ink delivery device, a type of filament is drawn out that, with a simultaneous traveling movement provokes a displacement of the metering site, it is more favorable to keep the ink filament as short as possible. This is achieved if the ink outlet opening is placed near the circumferential contour of the ink doctor. In addition, the ink filament is pulled in the direction of the metering site due to the rotary motion of the ink doctor. A resultant further advantage is a shortening of the idle time. In addition, the printing ink is made more rapidly uniform as a result. However, even in this type of metering, there is no preclusion that the remetered printing ink may not be made uniform immediately. This is true particularly for printing inks with high viscosity. The device according to the invention therefore proposes the installation of an agitator or stirrer acting under the surface of the printing ink located in the ink duct. The agitator produces a better uniformity of the printing ink and simultaneously prevents solidification or stiffening of the printing ink. The agitator, in the simplest case, can be a wire bow that causes only a slight rise in the filling level due to the small displacement, and therefore does not markedly effect the measurement value of a sensor assigned to the system, for sensing the ink volume present in the ink duct. In an advantageous construction, the agitator can simply be fastened by a so-called chip or catch-assembly to the traversing carriage whereon the metering device is mounted. Due to the simple assembly, a simple subassembly is possible, in order to clean the agitator outside the printing press, in the case of an ink change. The invention therefore proposes additionally that monitoring of the fill level in the ink duct not be performed until the sensor is moved one more time over the remetered metering region. The travel movement of the carriage on which a sensor, an ink cartridge and possibly an agitator or stirrer are located is adapted so that the restoring duration of a measurable fill level profile is given after one travel period.

In addition, the remetering of the printing ink is selected so that neither an overflow nor an emptying of the ink duct can occur. The travel movement can either be successive, with a fixed dwell time at given stop locations, or can be effected by a continuous motion. Advantageously, a travel distance measuring system can be dispensed with if, at the reversal position of the carriage, a position switch defines a zero position, and the carriage then covers the distance to the opposite side of the ink duct at a constant speed. Based upon the elapsed time, it is then possible, utilizing the equation $s=v\times t$, wherein s=distance, v=velocity and t=time, to state the carriage position precisely, for this application.

Other features which are considered as characteristic for the invention are set forth in the appended claims.

Although the invention is illustrated and described herein as an embodiment of a device and a method for metering printing ink into an ink duct of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENT

Figure 1:
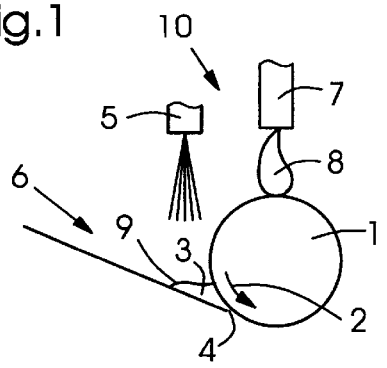
FIG. 1 is a diagrammatic side elevational view of the device for metering printing ink into an ink duct of a printing press according to the invention.

Referring now to the drawing and, first, particularly to FIG. 1 thereof, there is shown therein an ink doctor 1 rotatable in a direction indicated by the curved arrow 2. This ink doctor 1 draws printing ink for a defined ink layer from a printing ink reservoir 3, this ink layer resulting from a suitable adjustment of an ink zone opening 4. The ink zone opening 4 is adjustable zonewise or zone by zone by a conventional non-illustrated mechanism. A sensor 5 which, by way of example, operates on an optical or acoustical measurement principle, monitors the fill level 9 of the ink reservoir 3 which is located in an ink duct 6. An outlet opening 7 of an otherwise non-illustrated ink supply system is located above the ink doctor 1, and dispenses therethrough a quantity 8 of ink, which is represented only by way of example, to the ink doctor 1, the ink quantity 8 being transported into the ink duct 6 by the rotary motion of the ink doctor 1. The metering device 10 according to the invention is represented by both the sensor 5 and a non-illustrated cartridge located on a carriage heretofore known from the aforementioned published German Patent Document DE 195 12 727 A1, the carriage and its contents being reciprocatingly movable on a crossbar over the length of the ink duct 6.

Figure 1A:
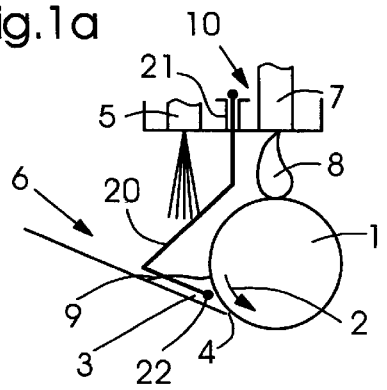
FIG. 1*a* is a view like that of FIG. 1 of the metering device with an agitator.

FIG. 1*a* illustrates an embodiment of the metering device having virtually the same components for metering printing ink as in the embodiment of FIG. 1, with the addition of an agitator 20. In the view of FIG. 1*a*, the sensor 5 and the outlet opening 7 for the printing ink are combined into one unit that is reciprocated above the ink duct 6 and the ink doctor 1, respectively. This unit 5, 7 may represent a housing to which also the agitator 20 is fastened. The agitator 20 may be a wire strap or bow that extends from one side of the housing of the metering device 10 around the ink doctor 1, dips into or is immersed in the ink reservoir 3, is provided in the axial direction of the ink doctor 1 with a geometrical shape advantageous for producing an agitating or stirring effect, and extends in a corresponding manner to the opposite side of the housing of the metering device 10. The simplest manner in which the agitator 20 may be fastened to the housing is by having a strap or bow-shaped structure with ends which are bent away at right angles engaging in holes provided therefor in the metering device 10. Spring action of the strap or bow-shaped agitator 20 and a groove 21 provided in the metering device 10 ensure that the agitator 20 remains stable in the position provided therefor and is additionally relatively easily exchangeable.

Figure 2:
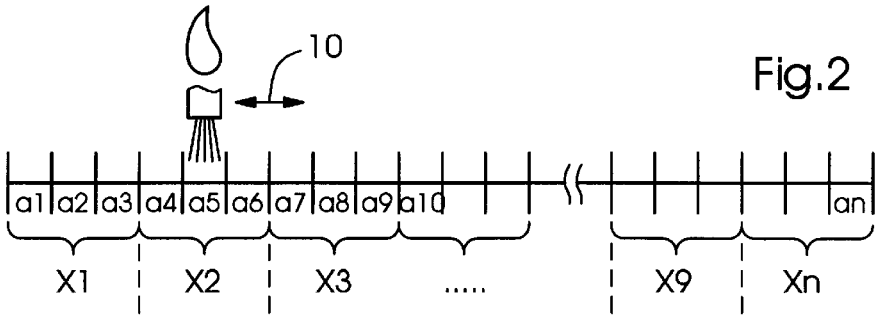
FIG. 2 is diagrammatic representation of the ink zones of an ink duct.

FIG. 2 representsd a row of ink zones a1 to an disposed side by side or adjacent one another. A monitoring of the fill level 9 by the sensor 5 and a filling by the ink quantity 8 are diagrammatically illustrated above the ink zone a5. It is believed to be readily apparent from the double-headed arrow 11 that the filling and monitoring of the fill level 9 is reciprocated over the ink zones a1 to an. The travel motion is either constant, in which case better distribution of the ink quantity 8 is effected with the filling, or the possibility exists of performing the metering operation for determining the fill level 9 by the sensor 5, and the filling, while the carriage is at a standstill.

The metering regions x1 to xn encompass a plurality of ink zones a1 to an, either a fixed relationship thereamong, or a relationship dependent upon the subject to be printed being able to result therefrom. In the case of the subject-dependent relationship, ink zones with mutual influence can be combined into one metering region x1 to xn. Mutual influence exists, for example, whenever ink zones a2 and a3 facing one another have extremely different ink zone openings 4. It is conceivable for the determination of the fill level 9 of a metering region x2 to be performed so that a mean value is formed for the fill level 9 of the ink zones a4, a5 and a6, or that the lowest fill level 9 trips a command for filling. During the filling, the lowest fill level 9 can also be taken into account so that the ink outlet opening 7 is positioned wherever the lowest fill level 9 prevails. This helps to make the ink reservoir 3 uniform.

Figure 3:
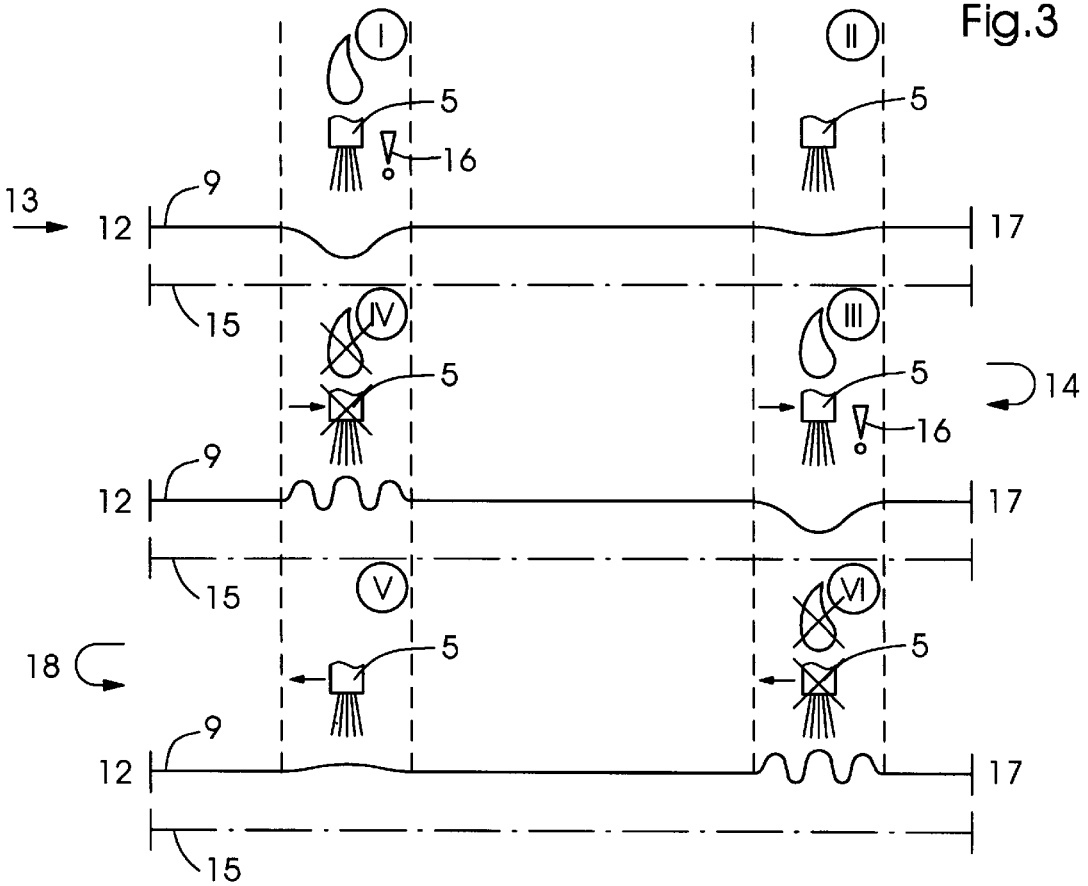
FIG. 3 is a plot diagram of a metering sequence according to the method of the invention, with diagrammatic explanatory illustrations of phases thereof.

FIG. 3 shows the course of a measuring or metering operation by way of example. Beginning at a zero position 12, a movement of the metering device 10 takes place in the direction of the arrow 13. The line extending over all the metering regions x1 to xn represents the fill level 9 of the ink reservoir 3, while the dot-dash or phantom line 15 represents the bottom of the ink duct 6. A reference measurement from the ink surface 9 down to the ink duct bottom 15 makes calibration of the sensor 5 unnecessary and, in addition, a calculation may be performed of the volume of the ink reservoir 3.

In the metering region x2, a lowered fill level 9 in the form of an instantaneous value I is noticeable, this lowered level 9 being also determined by the sensor 5 and leading to a remetering. This is represented by the exclamation point 16. The volume of the ink quantity 8 can either be determined from the fill level 9 ascertained by the sensor 5 or, in the case of a remetering, an ink quantity 8 that is always constant is established. Advantageously, the constant ink quantity 8 makes the process simpler. In the further movement of the metering device 10, a slight reduction in the fill level 9 is determined in the metering region x9 at the instantaneous value II, but this does not lead to a remetering. In that case, a prescribed minimum fill level can set or define the limit for tripping a remetering. This limit value is selected so that for a maximum ink zone opening 4 and, simultaneously, a maximum printing speed, the ink reservoir 3 will not be emptied from the ink duct 6 before a new crossover of the metering device 10 occurs again.

At a reversal position 17, the last metering region xn is crossed over, and a reversal in the travel direction of the metering device 10 takes place. This is clearly indicated by the arrow 14. The zero position 12 and the reversal position 17 can be defined job-specifically, as can also the metering regions x1 to xn. For example, when a relatively small format is being printed, placing limits on or bounding the ink duct 6 with so-called ink duct jaws is conventional. In that case, the zero position 12 and the reversal position 17 would be defined in accordance with the position of the ink duct jaws.

The next time the metering region x9 is crossed over in accordance with the instantaneous value III, a further lowered fill level 9 is found, which leads to a remetering. When the metering region x2 is crossed over, the instantaneous value IV prevails which, because of the remetering that has occurred in the return movement, does not permit a nonambiguous determination of the fill level 9. In that case, a measurement of the fill level 9 is not performed, which simultaneously also prevents a remetering.

Upon reaching the starting position 12, a reversal of direction again occurs as indicated by the arrow 18. Because the fill level 9 has been equalized or balanced, due to the time that has elapsed between the remetering occurring at the instantaneous value I until the crossover of the metering region x2 at the instantaneous value V, a measurement of the fill level 9 by the sensor 5 can be made without any occurrence of an incorrect measurement result. The situation wherein remetering is not necessary then occurs, however. When the metering region x9 is crossed over at the instantaneous value VI, the situation is identical to that at the instantaneous value IV, so that once again no measurement of the fill level 9 is made.

The travel period and the travel speed, respectively, with which the metering device 10 crosses over the metering regions x1 to xn, is dimensioned so that upon a second crossover of a remetered metering region x1 to xn, a measurable fill level 9 has been established. Because the restoration of a measurable fill level 9 is determined by the viscosity of the printing ink, the rotary speed of the ink doctor 1, or the printing speed, it is also conceivable for these parameters to be input into a control system for the metering device and on that basis to determine an optimized travel period and travel speed, respectively, or to derive a setting or adjustment from previously ascertained characteristic curves.

I claim:

1. A method for metering printing ink into an ink duct of a printing press, in which a metering device mounted on a carriage is reciprocatingly displaceable in a longitudinal direction of an ink duct having ink zones arranged next to one another in rows, the metering device including at least one sensor for monitoring a fill level in the ink duct, and a device for filling the ink in the ink duct, which comprises combining a plurality of the ink zones into a metering region; remetering printing ink to the metering region if a minimal fill level is determined by the sensor; and supressing a fill level measurement and remetering for at least one further crossover of the remetered metering region.

2. The method according to claim 1, which includes considering each metering region as an independent controlled system.

3. The method according to claim 1, which includes reciprocatingly moving the metering device periodically and, determining the periodic reciprocating movement by the capability of restoring a measurable fill level.

4. The method according to claim 1, which includes applying the printing ink onto the ink doctor.

5. The method according to claim 3, which includes defining the capability of restoring the measurable fill level as a function of the viscosity of the printing ink.

6. The method according to claim 3, which includes defining the capability of restoring the measurable fill level as a function of the rotary motion of the ink doctor.

7. The method according to claim 1, which includes combining those ink zones having mutual influence into the one metering region.

8. The method according to claim 1, wherein the reciprocating displacement is constant.

9. The method according to claim 1, which includes interrupting the reciprocating displacement of the metering device when a measurement and a metering position, respectively, are reached.

10. The method according to claim 1, which includes applying the equation $s=v\times t$, wherein s=distance, v=velocity and t=time, for determining the position of the ink zone and of the metering region, respectively, above which the metering device is located.

11. The method according to claim 10, which includes interrogating a position switch at a zero position and at a reversal position.

* * * * *